US005946997A

United States Patent [19]

Nicholson, Jr.

[11] Patent Number: 5,946,997

[45] Date of Patent: Sep. 7, 1999

[54] PLASTIC STRINGLINE CUTTER APPARATUS

[76] Inventor: William B. Nicholson, Jr., 813 Festoon Ct., Tyler, Tex. 75703

[21] Appl. No.: 08/598,730

[22] Filed: Feb. 8, 1996

[51] Int. Cl.[6] ..... B26D 5/20

[52] U.S. Cl. ..... 83/532; 83/589; 83/597; 83/820; 83/950; 30/287; 30/289; 30/290; 29/287; 29/295

[58] Field of Search ..... 83/949, 950, 597, 83/762, 581, 820, 761, 582, 589; 30/286, 289, 290; 269/286, 287, 290, 295; 144/216, 217

[56] References Cited

U.S. PATENT DOCUMENTS 4,073,059 2/1978 Wallace ..... 30/261

*Primary Examiner*—M. Rachuba

[57] ABSTRACT

In accordance with the invention, a plastic stringline cutter apparatus is provided which includes a base, an upright stand, and a faceplate that permanently connects unitary through which a slot with an oval acclivity or syncline is provided which accepts a ratchet paddleblade with a connecting handle that mounts springable, releasable and reversible in a unitary slot. In one embodiment the paddleblade with connecting handle which is manually springable operative has a plurality of incurvate xyresic edges, typically two, one upper and one lower. The upper incurvate xyresic edge when assembled workable protrudes through the faceplate angular providing a cutting element which manually ratchets with anti-frictional movement into the faceplate unitary slot with little or no wabble whereby plastic stringline placed thereacross is quickly severed by downward thrust of the paddleblade handle, where upon release the cutting element returns to normal open cutting position through memory contained in the springable element. The lower incurvate xyresic edge which is manually springable operative in and out of the oval acclivity or syncline, which by design of the sloping sides removes severability thereof in that situs, resulting in conversion to a crimping element or a marking element whereby a downward thrust of the paddleblade handle protrudes the lower incurvate xyresic edge out of the oval acclivity or syncline, stringline placed thereunder may be crimped or marked as desired by an upward thrust of the paddleblade handle thereby completing a dual function of the invention.

2 Claims, 4 Drawing Sheets

PLASTIC STRINGLINE CUTTER APPARATUS

This invention relates to a device for cutting line for winding onto a spool or attaching a line to a fixed head and relates more particularly to an apparatus for cutting plastic stringline such as nylon monofilament stringline for winding onto nonmetallic spools or that attach to a fixed line head for use in hand held staring trimmers.

BACKGROUND OF THE INVENTION

Hand held string trimmers are used in lawn and yard maintenance by homeowners and professionals. These trimmers include an electric motor or gasoline engine that rotates a hub from which a string projects. The rotation of the hub creates centrifical force which holds the string away from the hub. The operator manually guides the string trimmer so that the rapidly moving string comes in contact with vegetable matter such as grasses and weeds and severs the grasses and weeds at the point of contact.

The string used by the trimmer is commonly a nylon or other non-metallic monofilament and i s worn away by contact with vegetable matter or extra hard material such as woody plants or concrete. Many string trimmers include a supply of string to replenish the worn away portion of the string projecting from the cutting head. Such string trimmers commonly contain a semiautomatic or manual mechanism for advancing additional string from the supply to replace that string worn away outside the cutting head. When the original supply of string that is sold with a new string trimmer is exhausted the string must be replenished. The supply of string is commonly wound upon a removable and replaceable hard plastic spool or attached to a fixed line trimmer head. The quickest way to replenish the supply of string is to purchase a replacement spool which has the string prewound thereon. Prewound spools are available to homeowners and professionals. Although this method is simple it has the disadvantage of high cost. For continued use of the string trimmer there are other methods available for the trmmer operator to reload an empty spool. The operator may reload the empty spool by hand winding the string in accordance with instructions supplied with the purchase of the trimmer, or use a spool winding apparatus available for purchase in commerce. Another method for continued use of the string trimmer is to replace the semi-automatic manual mechanism for advancing additional line with a fixed line head. Fixed line heads are available for purchase by homeowners and professionals.

Trimmers that use fixed line heads do not have a supply of string that can be advanced when the string is worn away. The fixed line head has an attachment means whereby short lengths of stringline can be attached; commonly one or two pieces of stringline are attached in a fixed position so that two or four ends extend substantially equal distance outside the hub. The cutting action is the same as other hand held trimmers described above. The only difference is that when string is worn away the remaining portion must be removed and replaced with new stringline.

There is little commonality in the size of trimmer spools used by differing manufacturers. The same is true of the manner in which the stringline is attached to spools. Some use single lines and some use dual lines and the method of attaching the stringline varies considerably. Many manufacturers use a single hole slightly larger than the diameter of the stringline; others use a plurality of holes to accommodate both single line and dual line spools. Then again there may be a single hole adjacent to the spool hub and its side wall wherein the dual stringline is looped through to a center point for rewinding onto the empty spool. All methods have problems in withdrawing, cutting, measuring and attaching stringline to rewinding an empty trimmer spool or attaching stringline to a fixed line trimmer head.

Monofilament stringline is available for purchase in various size packages or spools, the length of which range from approximately 50 feet to thousands of feet. The manner of packaging, spool or coiled packages, presents many problems for the user. Upon removal the line is in a semi-coiled state, more so with smaller packaging, and can quickly become tangled beyond useability.

The trimmer operator may use replacement string from a bulk supply or purchase a prewound spool or purchase precut short lengths of stringline for use in a fixed line head. Due to the high cost of prewound spools and precut stringline, high volume users of string trimmers choose to cut stringline from a bulk source such as one pound donut packages or larger bulk source such as three and five pound spools. There is little commonality for removal of stringline from a bulk source. Some operators improvise to obtain the required stringline from a bulk source, which often results in tangled unmanageable kinked line. There are dispensers available for purchase; however, due to high cost or lack of suitability, few are being used by homeowners and lawn maintenance companies. When stringline is removed from a bulk source two hands are required to measure and cut the recommended lengths.

Hand held tools are generally used to cut stringline, such as side cutting pliers or similar cutting tools, which have several disadvantages. Hand held tools are awkward to use and must be laid down and picked up several times during the measuring and cutting process. Also, hand held tools are easily lost or misplaced and do not always cut the stringline efficiently. The line is mashed out of shape at the point of cut or is not cut, which requires reshaping or repositioning the line for a recut which creates an attachment problem in that the holes provided are generally slightly larger than the diameter of the stringline. Therefore a mashed line is impossible to place in holes provided.

Thus there is a need for a device to which a bulk stringline source may be rotatably mounted and from which stringline may be rotatably transferred direct to an empty trimmer spool or be quickly withdrawn and cut without being tangled or mashed for hand winding onto an empty trimmer spool.

Furthermore there is a need for a cutting device that eliminates the awkward hand held cutting tool which can be permanently mounted, and that cuts all sizes of stringline, such as 0.065, 0.080, 0.095, 0.105 and 0.130 every time without being mashed, for use in rewinding empty trimmer spools or for use in fixed line trimmer heads. Various cutting devices have been developed that use grooves and slots for cutting guides to miter cuts in such material as wood, rubber, plastic and string yarn. For example:

Griffith U.S. Pat. No. 592,139 discloses miter boxes to guide a saw in cutting kerfs for the formation of dovetail connections between sides and ends of boxes and other rectangular receptacles formed of wooden boards or other available materials.

Ludwig U.S. Pat. No. 1,718,791 discloses miter bixes for cutting mitered ends in corner beads, coping or other metal strips folded, shaped or formed from sheet metal; further the invention provides a channel shaped miter box for corner beads which provides adjustable supports mounted within the channel body portion which may be moved vertically to accommodate different shapes or sizes of corner beads.

Curacio U.S. Pat. No. 3,782,235 discloses an improved miter box for use by carpenters and others in making miter joints particularly for mitering picture, cove, casing and base moldings. The general improvement lines in substituting a square shaped box for the conventional U-shaped form, and making this miter box in the form of a single integrally molded transparent plastic unit. It improves durability of the miter box and increases precision in cutting because the saw will not easily cut into the saw cutting guide of its side walls.

Wylier U.S. Pat. No. 3,811,356 discloses a miter box having spaced saw kerfs arranged in aligned pairs and having a horizontal bottom formed by two mating horizontally elongated horizontal members detachably engageable in abutting coplanar relationship wherein means are provided for detachable insertion between said horizontal members to enlarge the width of the box.

Slemmons U.S. Pat. No. 3,837,253 discloses an E-shaped cross section guide for cutting art frames and similar materials. This guide comprises three parallel ridges coupled to base and spaced so that two parallel planar portions of the poster frame slide and fit snugly over the center ridge for cutting 90° angles and 45° angles to be used for mitering poster frames.

Ludvik U.S. Pat. No. 4,093,200 discloses a device for cutting yarn which comprises a drum having a plurality of narrow grooves in the outer surface for holding the yarn in place on the outer surface of the drum and base support for holding the drum.

Rouse U.S. Pat. No. 4,095,500 discloses an accurate, inexpensixe angle cutting guide for use in carpentry which gives a saw a rigid and perfect guide for any 45° or 90° cut whether the cut be horizontal or perpendicular. This invention is a miter box employing slots of various angles such as 45°, 90°, and 135° to make miter joints particularly for mitering picture, cove, casing and base moldings.

Horwath U.S. Pat. No. 4,281,827 discloses an improved miter box that allows crown molding to be cut in the same orientation in which it will be installed to assure a perfect miter joint. Further a miter box is disclosed for holding a longitudinal work piece to be cut by saw or other cutting device at a measured angle parallel to the longitudinal axis of the work piece and simultaneously at a second angle measured in a plane perpendicular to the longitudinal axis of the work piece.

O'Neill U.S. Pat. No. 4,436,014 discloses a miter box suitable for cutting a mitered end on a strip of L shape in cross section that has a receiving slot extending from edge to edge in an upper surface to receive the strip of material and two cutter guide slots at right angles to one another, the slots having a common intersection with the receiving slot at one of the edges of the upper surface.

Stoller U.S. Pat. No. 5,522,296 discloses a cove base cutting guide comprising slits at various angles, typically 90° +45° and −45° to the chamber, such that a cove base in the chamber is cut at a given angle by a utility knife in the slit.

Nicholson U.S. Pat. No. 5,056,732 discloses a device for winding line onto a trimmer spool that is generally cut with hand held tools and relates more particularly to an apparatus for winding plastic line such as nylon monofilament string onto a non-metallic spool for use in a hand held string trimmer.

Wallace et al U.S. Pat. No. 4,073,059 discloses a hand held pruning shear of the hook style or pass-by type wherein the crossed layers are pivoted in combination with a power element providing a severing function which is specifically designed for cutting woody plants and would be inefficient for cutting tough semirigid plastic stringline.

Prior art references cited to Stoller U.S. Pat. No. 5,522,296 are listed by name and U.S. Patent Number only as each is listed separately above:

Griffith U.S. Pat. No. 592,139
Ludwig U.S. Pat. No. 1,718,791
Curcio U.S. Pat. No. 3,782,235
Wyler U.S. Pat. No. 3,811,356
Slemmons U.S. Pat. No. 3,837,253
Rouse U.S. Pat. No. 4,095,500
O'Neill U.S. Pat. No. 4,436,014
Wallace et al U.S. Pat. No. 4,073,059

SUMMARY OF THE INVENTION

In accordance with the invention, a plastic stringline cutter apparatus is provided which in one embodiment includes a base, an upright stand, a faceplate, a slot with an oval acclivity or a syncline, and a paddleblade with a connecting handle. The base, upright stand, and faceplate are permanently connected adhesively through which a slot is provided that accepts a paddleblade in a releasable secured operational manner which is also springable within the slot by removal of the frictional fitted paddleblade ratchet pin, and is reversible if desired. The paddleblade has a plurality of incurvate xyresic edges, typically two, one on either side of its longitudinal center line. When mounted in the upright stand slot one incurvate xyresic edge protrudes through the faceplate slot at an angle that forms a cutting element and the other incurvate xyresic edge located in the lower portion of the slot within an oval acclivity or syncline is convertible to a crimping and/or marking element. A user may pull a desired length of stringline from a bulk source across the incurvate xyresic edge, pushing the paddleblade handle downward to sever the stringline every time without being mashed. Also, sharp pointed angle cuts are made in the same manner by holding the stringline angled between the incurvate xyresic edge and the faceplate whereby a downward thrust severs the tip thereof. The incurvate xyresic edge that protrudes into the oval acclivity or syncline converts to a crimping and/or marking element that aids a user in attaching a stringline to a reusable non-metallic trimmer spool. Plastic stringline is relatively stiff and by crimping the center point and/or the beginning end, the line winds tightly and evenly, which helps prevent line freezeup.

While the invention will be described in connection with a particular embodiment, it will be understood that the description is not intended to limit the invention to those embodiments. On the contrary, the description is intended to cover all alternatives, modifications, and equivalencies that may be included with the spirit and the scope of the invention as defined by the appended claims.

DETAILED DESCRIPTION OF THE INVENTION

Figure 1A:
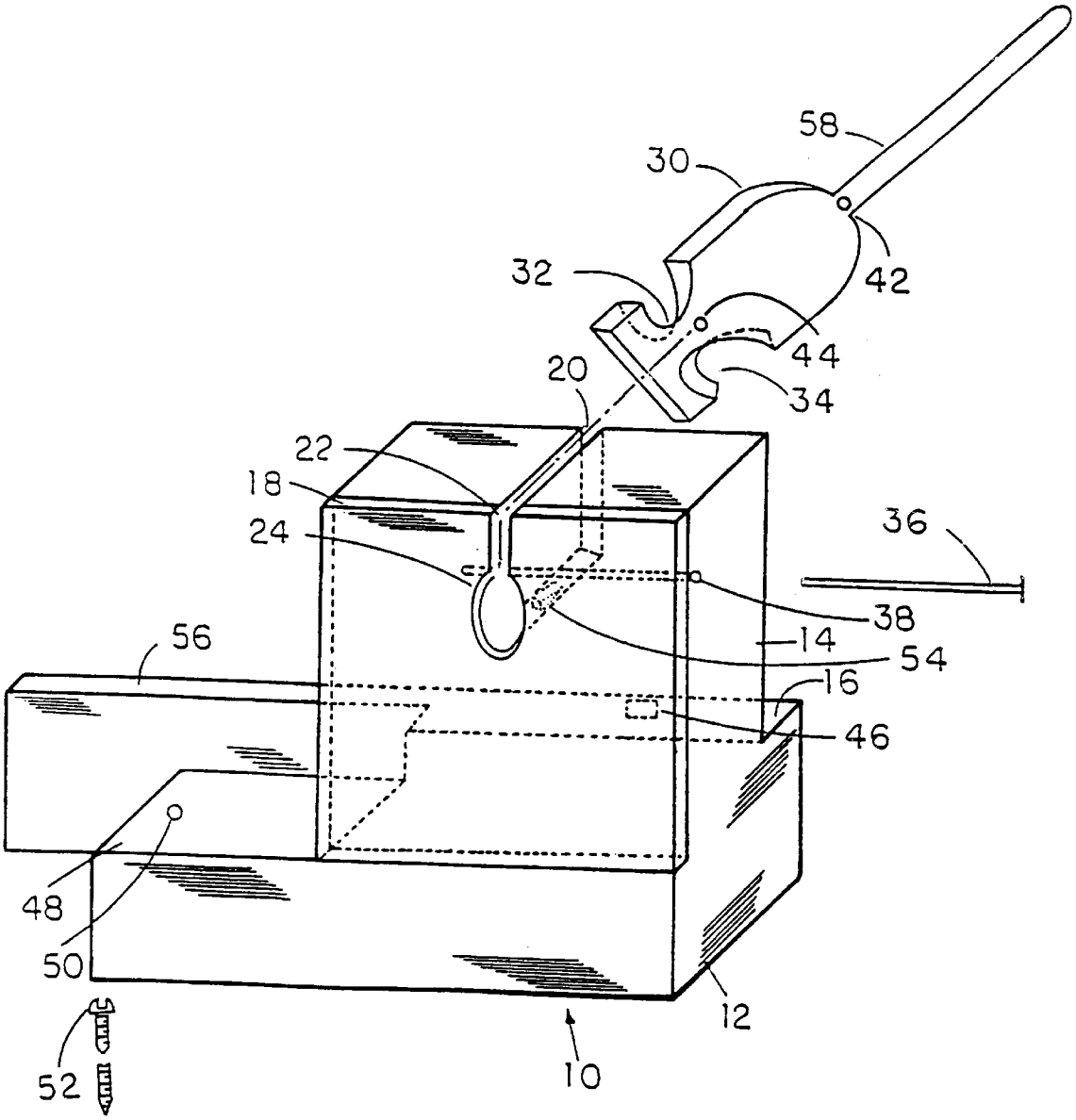
FIG. 1A is an elevation of an embodiment of the plastic stringline cutter apparatus.

Turning now to the drawings and first to FIG. 1A, there is shown a plastic stringline cutter apparatus 10. The apparatus 10 includes a base 12, having an upright stand portion 14 including and upright stand ratchet slot 20 and an upper flat base surface 16 with an attachment key 56, fitted sidewise therealong and extending beyond base 12 and the upper flat base surface 16 as a stabilization attachment guide as shown in FIG. 1A. Each of the foregoing parts may be made of appropriate wood laminated together with suitable adhesive. Further, there is a faceplate 18 that may be made of quality steel or high impact plastic that includes a faceplate ratchet slot 22 that joins cohesively with the upright stand 14 and upright stand ratchet slot 20, respectively. Due to high cost of steel, high impact plastic may be used for faceplate 18 that secures to upright stand 14 with a plurality of faceplate mating barbs 26 shown in FIG. 1C and FIG. 1D insertible adhesively fixed in a plurality of faceplate mating barb holes 28, completing assemblage of basic apparatus 10.

The upright stand 14 and faceplate 18 are provided with an upright stand ratchet slot 20 and a faceplate ratchet slot 22, respectively, the dimensions thereof being predetermined to accept paddleblade 30 with connecting handle 58, which provides the propelling force necessary for functional operation of the stringline cutter apparatus 10. A snub 54 made of suitable wood or plastic secures permanently within the lower front portion of upright stand ratchet slot 20 which limits the forward ratchet movement of paddleblade 30 thereby retaining springable element 40 firmly seated non-adhesively in springable element bore 46 as shown in FIG. 1D. Also, there is an oval acclivity or syncline 24 situated in the lower portion of faceplate ratchet slot 22, sandwiched approximately between the lower rear lines of faceplate ratchet slot 22 and the lower beginning lines of upright stand ratchet slot 20 respectively. The sloping sides of oval acclivity or syncline 24 remove severability of lower incurvate xyresic edge 34 when assembled in that situs.

Due to high cost of manufacturing and assemblage, base 12, upright stand 14, upper flat base surface 16, attachment key 56, faceplate 18 with upright stand ratchet slot 20 and faceplate ratchet slot 22, respectively, together with oval acclivity or syncline 24, and snub 54 including paddleblade ratchet pinholes 38, may be injection molded of high impact plastic into one body, stringline cutter apparatus 10.

Figure 1B:
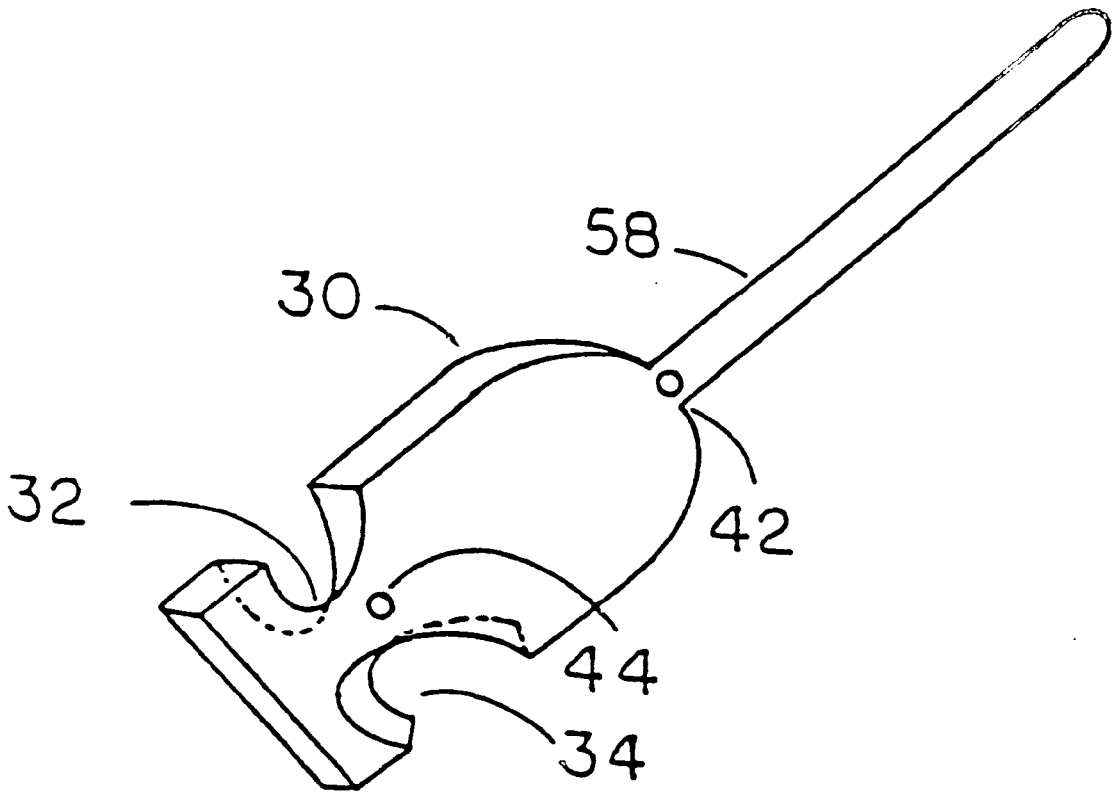
FIG. 1B shows the curved cutting edges of the paddleblade cutter.

Moving now to FIG. 1B in which there is shown an embodiment of paddleblade 30, with connecting handle 58 made of quality steel suitable to activate the severing function of the plastic stringline cutter apparatus 10, when placed in workable assembled position is snugly slideable when secured within upright stand ratchet slot 20 and faceplate ratchet slot 22, respectively, with a paddleblade ratchet pin 36 transversely passed through paddleblade ratchet pinholes 38 extending through paddleblade ratchet aperture 44. The placement of paddleblade ratchet aperture 44 is predetermined forwardly along the longitudinal center line of paddleblade 30 providing efficient use of the cutting element of the invention.

Paddleblade 30 is provided with a plurality of cutting edges, typically two, such as upper incurvate xyresic edge 32 and lower incurvate xyresic edge 34, located on either side of the longitudinal center line of paddleblade 30 as shown in FIG. 1B, that manually operates anti-frictional with little or no wabble within the walls of upright stand ratchet slot 20 and faceplate ratchet slot 22, respectively. The upper incurvate xyresic edge 32 and lower incurvate xyresic edge 34 are formed by cross-sectional cutouts in the surface of paddleblade 30, the angle across the thickness of paddleblade 30 being between 43° and 49°, typically about 46°, the angle thereof being salient to allow relinquishment of stringline ends following the severing function thereof. The angle of taper forming upper incurvate xyresic edge 32 and lower incurvate xyresic edge 34 may be from right to left or left to right terminating at the surface of paddleblade 30 in the direction of connecting paddleblade handle 58 which forms suitable cutting edges.

Figure 1C:
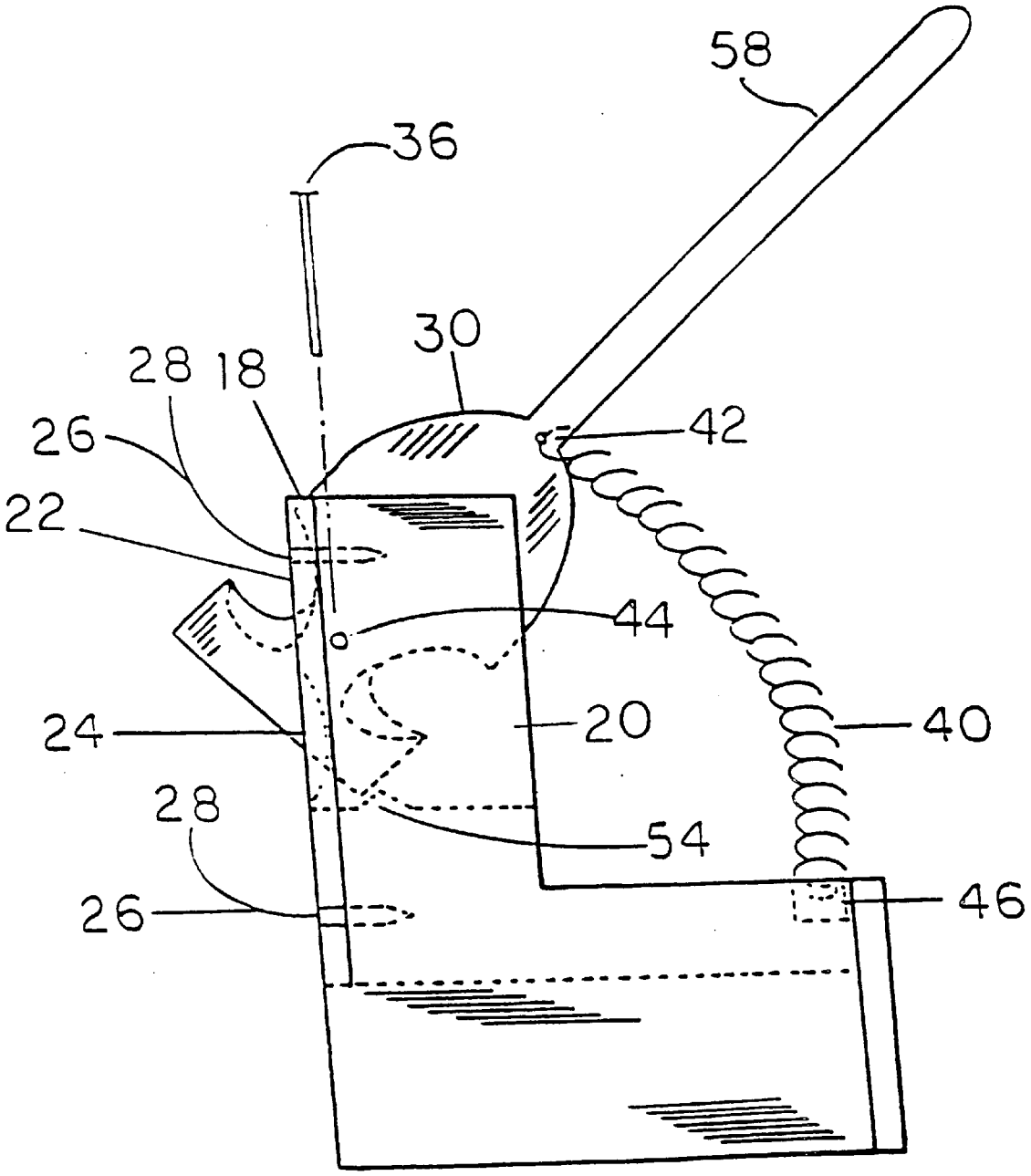
FIG. 1C shows the paddleblade cutter attached to the base.
Figure 1D:
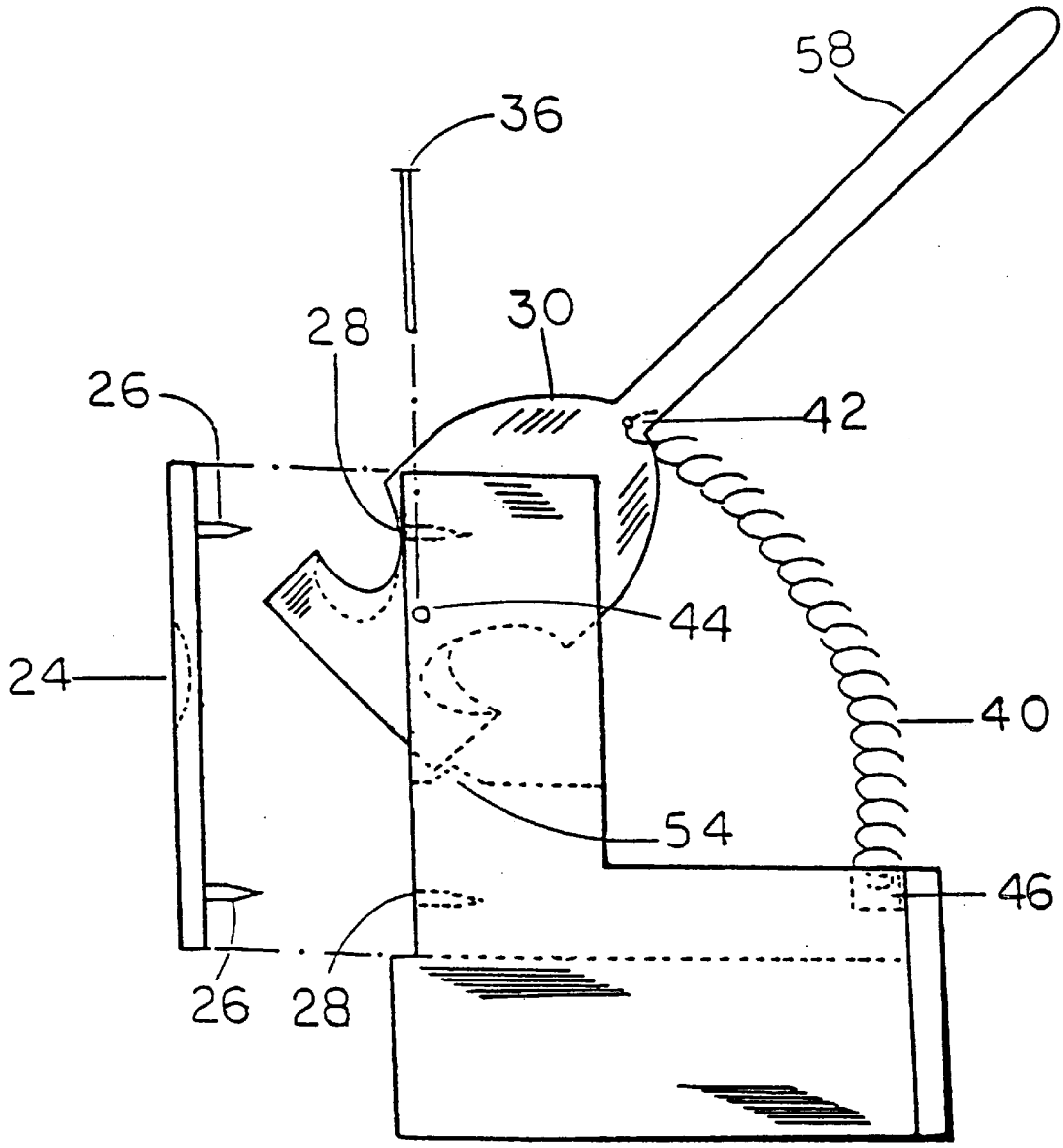
FIG. 1D shows the apparatus, with details to the faceplate.

Further describing the cutting element of plastic stringline cutter apparatus 10, the curve in upper incurvate xyresic edge 32 and lower incurvate xyresic edge 34 is similar to that of an isometric ellipse with a 30°–60° diameter that measures between 0.5625 and 0.6875, typically about 0.6250, which appears hooklike when assembled protruding through faceplate ratchet slot 22 as shown in FIG. 1C. One reading the description of paddleblade 30 together with handle 58 and cutting elements upper incurvate xyresic edge 32 and lower incurvate xyresic edge 34 may conclude similarity thereof providing reversibility which extends operational functionality thereof. Paddleblade 30 is quickly removable for reversibility or replaceability by withdrawing paddleblade ratchet pin 36 from frictional fitted cooperative paddleblade ratchet pinholes 38.

Now referring to FIG. 1A, paddleblade 30 is shown securable in upright stand ratchet slot 20 and faceplate ratchet slot 22 respectively, and more particularly shown inserted in respective slots 20 and 22 as disclosed in FIG. 1C. The upper incurvate xyresic edge 32 that protrudes through faceplate 18 as shown in FIG. 1C is held in normal severing position with a springable element 40 bias between springable element attachment hole 42 in paddleblade 30 and a springable element attachment bore 46 located releasable in upper flat base surface 16. The power to activate upper incurvate xyresic edge 32 is provided by a downward thrust of paddleblade handle 58 directing upper incurvate xyresic edge 32 with plastic stringline trapped in the cutting element curve thereof moving the plastic stringline toward faceplate 18 where upon contact with the perpendicular corners of faceplate ratchet slot 20 the stringline becomes semirigid and force therein begins to develop and continues as the cutting element moves the stringline past and beyond into faceplate ratchet slot 20, thereby completing the severing function. Upon completion of the cutting action and release of paddleblade handle 58, through recall contained in springable element 40, paddleblade 30 returns to the normal open cutting position. The lower incurvate xyresic edge 34 being manually springably operative in and out of oval acclivity or syncline 24 in that situs has the severability removed therefrom by the geometry of the sloping sides thereof. The lower incurvate xyresic edge 34 without severability converts to a stringline crimping or marking element. An operator may press handle 58 fully downward protruding lower incurvate xyresic edge 34 out of oval acclivity or syncline 24 and stringline placed thereunder may be center marked or end crimped as desired by pulling the paddleblade handle 58 fully upward to or near snub 54.

The plastic stringline cutter apparatus 10 as shown in FIG. 1A and FIG. 1D may be mounted to a flat surface such as a workbench secured by a mounting screw 52 insertable in a mounting screw hole 50 in a flat surface 48 or attached to a suitable flat surface on a lawn vehicle. The use of a single mounting screw 52 permits directional alignment with a rotary plastic stringline dispenser available for purchase in commerce.

In operation, the reader will realize that the use of the stringline cutter apparatus 10 is designed specifically to sever plastic monofilament stringline of all sizes without being mashed, such as 0.065, 0.080, 0.095, 0.105 and 0.130.

The lower incurvate xyresic edge 34 being springably operative in and out of the oval acclivity or syncline 24 has a dual purpose. It may be used to replace the upper incurvate xyresic edge 32 if need be, and while in the lower position it is operable as a stringline crimping or marking element.

There are additional advantages to the stringline cutter apparatus 10 in that:

it provides for permanent mounting on a flat surface such as a workbench, table, wall, or a lawn vehicle for convenient use by homeowners and high volume users of hand held stringline trimmers;

it eliminates the use of awkward hand held cutting tools that must be laid down and picked up repeatedly during operational use;

it frees both hands that are required to manage, measure, and cut stringline for use in stringline trimmers;

it provides a better way of measuring long lengths of stringline as an operator using premeasured increments pulls one half of the required line, crimps the center, then doubles line back to the beginning end for the exact length required, which is then cut using the stringline cutter apparatus 10;

it provides a quick, easy way for cutting a sharp point on a stringline which helps one thread or place stringline in small attachment holes;

it allows one to establish a measured pull-to-stop for cutting exact lengths of stringline for use in a fixed line trimmer head.

Furthermore, this stringline cutter apparatus 10 has additional advantages in that:

it permits rapid withdrawal of stringline from an economical rotary bulk stringline source directly across the incurvate xyresic edge for severing as one desires;

it permits rapid cutting of long lengths of stringline for rewinding empty trimmer spools;

it permits a better way for one to mark the center of a stringline for use in rewinding dual line trimmer spools;

it permits a better way to crimp the end of a stringline that allows stiff stringline to hug the spool spindle, which lets one wind the line tightly and evenly minimizing line freezeup;

it eliminates the loss of hand held cutting tools, which is a major problem for high volume users of hand held string trimmers;

it reduces frustrations of cutting stringline for use in winding empty trimmer spools;

it is easy to use, no additional tools needed;

it saves time and money for operators of hand held string trimmers;

it permits easy, smooth, quick cuts of stringline.

Thus it is apparent that there is provided, in accordance with the invention, a plastic stringline cutter apparatus that fully satisfies the object's aims and advantages set forth above. While the invention has been described in conjuction with specific embodiments thereof, it is evident that many alternatives, modifications, and variations will be apparent to those skilled in the art in light of the foregoing description. Accordingly, it is intended to embrace all such alternatives, modifications and variations that fall within the spirit and broad scope of the appended claims.

What is claimed is:

1. A cutting apparatus comprising:

a base;

a stand mounted on the base, the stand comprising a slot, the slot extending through the width of the stand, the slot having a snub placed in the bottom of the slot, the lower section of the slot being of oval cross-section;

a faceplate, the faceplate having a slot, the lower section of the slot being of oval cross-section;

the stand comprising a plurality of holes and the faceplate comprising a plurality of barbs, the barbs of the faceplate mating with the holes of the stand, to connect the faceplate to the stand;

the stand further comprising a second hole;

a body comprising a means for cutting, a handle means for actuating the means for cutting; a hole, and a pin, wherein the pin releasably engages the hole in the body, and the second hole in the stand to attach the body to the stand;

the cutting means comprising two cutting edges, the cutting edges positioned on either side of a longitudinal axis of the body; and means for biasing the body to an open position in the stand, wherein the open position allows a workpiece to be placed in the stand slot and the faceplate slot, the workpiece being cut by the cutting means when the handle is actuated to move the body against the means for biasing the body.

2. The cutting apparatus of claim 1, wherein the cutting edges are convex, and taper in the direction of the handle means.

* * * * *